US011125503B2

(12) United States Patent
Kajitani

(10) Patent No.: US 11,125,503 B2
(45) Date of Patent: Sep. 21, 2021

(54) MELTING FURNACE

(71) Applicants: Tsuyoshi Kajitani, Kyotanabe (JP); NIPPON CRUCIBLE CO., LTD., Tokyo (JP)

(72) Inventor: Tsuyoshi Kajitani, Kyotanabe (JP)

(73) Assignees: Tsuyoshi Kajitani, Kyotanabe (JP); NIPPON CRUCIBLE CO., LTD., Tokyo (JP)

( * ) Notice: Subject to any disclaimer, the term of this patent is extended or adjusted under 35 U.S.C. 154(b) by 0 days.

(21) Appl. No.: 17/043,875

(22) PCT Filed: May 20, 2020

(86) PCT No.: PCT/JP2020/019860
§ 371 (c)(1),
(2) Date: Sep. 30, 2020

(87) PCT Pub. No.: WO2020/235579
PCT Pub. Date: Nov. 26, 2020

(65) Prior Publication Data

US 2021/0055052 A1 Feb. 25, 2021

(30) Foreign Application Priority Data

May 23, 2019 (JP) ..... 2019-096733

(51) Int. Cl.
*F27B 3/22* (2006.01)
*F27B 3/04* (2006.01)
*F27B 3/20* (2006.01)

(52) U.S. Cl.
CPC ..... *F27B 3/045* (2013.01); *F27B 3/205* (2013.01); *F27B 3/22* (2013.01)

(58) Field of Classification Search
CPC ..... F27B 3/045; F27B 3/205; F27B 3/22
See application file for complete search history.

(56) References Cited

U.S. PATENT DOCUMENTS 4,781,581 A * 11/1988 Bleickert ..... C22B 7/003 432/156
4,850,577 A * 7/1989 Yamaoka ..... C22B 21/0084 266/229

(Continued)

FOREIGN PATENT DOCUMENTS

CA 1333217 C 11/1994
CA 1337456 C 10/1995

(Continued)

OTHER PUBLICATIONS

Kajitani; "The inhibition furnace of inhibition furnace [of an oxide besides Ken]"; Casting Journal; 2017; vol. 13; No. 6; pp. 8036-8039 (4 pages)/Cited in the Int'l Search Report dated Aug. 25, 2020 for Int'l App. No. PCT/JP2020/019860/ Cited in JP-OA dated Jul. 2, 2019 for corr. App. No. JP 2019-096733.

(Continued)

*Primary Examiner* — Scott R Kastler
(74) *Attorney, Agent, or Firm* — Kratz, Quintos & Hanson, LLP

(57) ABSTRACT

A melting furnace includes a melting portion to which a metal material is supplied; a burner for melting the metal material in the melting portion; a heating portion that receives the molten material from the melting portion; a temperature regulating portion that receives the molten material from the heating portion; a separator that separates the heating portion and the temperature regulating portion, wherein the lower portion of the separator is immersed in the molten material to form, below the separator, an inlet; an immersion heater wherein at least part of the immersion heater is immersed in the molten material in the temperature regulating portion; and a gas introduction path that is formed in the separator, and that introduces combustion gas from the burner into a space above the molten material in the tem- (Continued)

perature regulating portion; wherein the burner is controlled so that the combustion gas has an oxygen concentration of 5% or less.

5 Claims, 8 Drawing Sheets

(56) References Cited

U.S. PATENT DOCUMENTS

| | | | | |
|---|---|---|---|---|
| 5,026,030 | A | 6/1991 | Inukai | |
| 7,060,220 | B2 * | 6/2006 | Nakashima | C21C 5/567 266/229 |
| 7,235,210 | B2 | 6/2007 | Nakashima | |
| 2004/0217526 | A1 | 11/2004 | Nakashima | |
| 2006/0027953 | A1 | 2/2006 | Nakashima | |
| 2015/0042024 | A1 * | 2/2015 | Nakashima | F27B 3/205 266/155 |

FOREIGN PATENT DOCUMENTS

| | | | |
|---|---|---|---|
| CA | 2346887 | A1 | 5/2000 |
| CA | 2999356 | A1 | 4/2017 |
| CN | 1734221 | A | 2/2006 |
| DE | 1458171 | A1 | 12/1968 |
| JP | S59-185982 | A | 10/1984 |
| JP | H02-97890 | A | 4/1990 |
| JP | H07-270074 | A | 10/1995 |
| JP | H09-066357 | A | 3/1997 |
| JP | 2006-071266 | A | 3/2006 |
| JP | 3860135 | B2 | 12/2006 |
| JP | 4198224 | B2 | 12/2008 |
| TW | 201018862 | A | 5/2010 |

OTHER PUBLICATIONS

The 170th Time Lecture Convention Summaries; Japan; Nippon Chuzo Kogakukai; Sep. 2017; p. 113; Session 114 (1 sheet)/ Cited in the Int'l Search Report dated Aug. 25, 2020 for Int'l App. No. PCT/JP2020/019860/ Cited in JP-OA dated Jul. 2, 2019 for corr. App. No. JP 2019-096733.

International Search Report for International Application No. PCT/JP2020/019860 dated Aug. 25, 2020 (2 sheets).

Office Action of corresponding Japanese Patent Application No. 2019-096733: Notice of Reasons for Refusal dated Jul. 2, 2019 (3 sheets, 3 sheets translation, 6 sheets total).

Office Action of corresponding Canadian Patent Application No. 3,095,504 dated Nov. 4, 2020 (5 sheets).

Office Action of corresponding Chinese Patent Application No. 202080005365.7 dated Jul. 28, 2021 (9 sheets, 15 sheets translation, 24 sheets total).

* cited by examiner

PRIOR ART

PRIOR ART

PRIOR ART

PRIOR ART

MELTING FURNACE

TECHNICAL FIELD

The present invention relates to a melting furnace for melting metal materials such as aluminum and aluminum alloys, and for holding the melted metal materials (referred to below as "molten materials").

BACKGROUND ART

At present, in the process of melting and holding metal materials such as aluminum and aluminum alloys, there is no high-efficiency melting furnace that corresponds to the oxidation mechanism of molten materials (also referred to below as "melted metal").

A conventional melting furnace 100 is shown in FIGS. 5 to 8. A melting portion 102 is located under a preheating portion 101, and a burner 103 is provided in the melting portion 102. A metal material, such as aluminum, is supplied into the melting portion 102 through an opening 105 that is positioned above the preheating portion 101, and that is openably and closably closed with a lid 104, and then is melted by heating with the burner 103 into a molten material. The molten material flows on a slope 106 and is supplied to a temperature regulating portion 107. A burner 108 is provided in the temperature regulating portion 107, and the temperature of the molten material in the temperature regulating portion 107 is maintained or raised to a predetermined temperature by the burner 108. The molten material in the temperature regulating portion 107 flows under a lower edge 110 of a separator 109, and enters a pumping portion 111. The molten material in the pumping portion 111 can be used in the casting or molding process by using external casting or molding equipment. The melting portion 102 has a door 112, which can be opened for inspecting and cleaning the melting portion 102. The temperature regulating portion 107 also has a door 113, which can be opened for inspecting and cleaning the temperature regulating portion 107.

In the conventional melting furnace 100, the molten material melted with the burner 103 in the melting portion 102 flows into the temperature regulating portion 107 that is connected to the melting portion 102 via the slope 106. However, during that time, an oxide 114 generated in melting may flow into the temperature regulating portion 107 together with the molten material, and the molten material may mix with the oxide 114 in the temperature regulating portion 107. The temperature of the molten material in the temperature regulating portion 107 is controlled to a predetermined temperature by the burner 108 mounted to a ceiling lid 115; however, the molten material, which is held at a high temperature in the temperature regulating portion 107, causes an oxidation reaction with air in the temperature regulating portion 107, which may increase an oxide 116 in the temperature regulating portion 107, thereby generating agglomerates. Accordingly, in the conventional melting furnace 100, an operator needs to open the door 113 to constantly clean the temperature regulating portion 107.

However, since the cleaning of the temperature regulating portion 107 is performed at a high temperature, and the oxide 116, which has remained at a high temperature for a long time without removal, is firmly attached to the inner wall 117 of the temperature regulating portion 107, the complete removal of the oxide 116 from the temperature regulating portion 107 is an excessive burden on the operator. Further, if fragments of the oxide 116 are mixed into the molten material, they become impurities when the molten material is used in a casting process or the like, and the quality of the molten material as a product deteriorates. Furthermore, when the oxide 116 increases and accumulates on the inner wall 117 of the temperature regulating portion 107, the oxide 116 serves as a heat insulating layer to reduce the volume of the space of the temperature regulating portion 107, and thus, raising the ambient temperature in the temperature regulating portion 107 is required to maintain the molten material at a high temperature. Moreover, change or deterioration of the insulating layer of the inner wall 117 of the temperature regulating portion 107 may cause heat leakage to the outside of the melting furnace 100.

Accordingly, in order to improve the quality of the molten material as a product, and further to reduce the burden on the operator, it is necessary to suppress the oxidation of the molten material in the temperature regulating portion 107, and minimize the production amount of the oxide 116.

As a prior art document, Patent Literature 1 (PTL 1) suggests a metal melting and holding furnace in which melted metal in a holding chamber is kept warm well, the heat loss of an electric heater as a heating means is suppressed to reduce the power consumption, and oxide generated by the reaction of the molten material and oxygen are reduced. The metal melting and holding furnace of PTL 1 includes a melting chamber for melting a metal material with a melting burner, and a holding chamber that is connected to the melting chamber through a connecting hole, and that keeps the melted metal melted in the melting furnace at the predetermined temperature by a heating means, wherein the heating means provided in the holding chamber is a heater, and the connecting hole that connects the melting chamber and the holding chamber is disposed at least below the normal metal line of the molten material stored in the holding chamber. The electric heater is, for example, housed and placed in a substantially horizontal state on the ceiling lid of the holding chamber, and uniformly heats approximately the whole area of the liquid surface of the molten material in the holding chamber.

As a prior art document, PTL 2 suggests a metal melting furnace in which impurities, such as metal oxides, generated in melting can be easily removed, and no or little flux is used, whereby a cleaner molten metal can be obtained. In the metal melting furnace of PTL 2, a separation wall is provided between an inclined hearth and a reservoir to define a processing portion, the separation wall is provided with a connecting passage between the reservoir and the processing portion, at a height level higher than a bottom surface of the processing portion, the separation wall is provided on its upper portion with an exhaust gas passage which permits exhaust gas discharged from the molten metal reservoir to pass therethrough, and an inspection opening with a door is provided in a furnace wall surface to open into the processing portion.

As a prior art document, PTL 3 suggests a melted metal holding furnace that reduces the generation of oxides in the furnace and facilitates maintenance such as cleaning of the furnace and replacement of a heater, wherein the production efficiency of casting and the quality of the product are improved. In the melted metal holding furnace of PTL 3, an immersion heater is obliquely installed in an installing hole on a furnace wall so that the heater is immersed in the molten material. The opening of the installing hole on the inner side of the furnace is provided below the melted metal surface, and the opening of the installing hole on the outer side of the furnace is provided above the melted metal surface. The portion having a heating wire of the immersion heater is located below the melted metal surface.

CITATION LIST

Patent Literature

PTL 1: Japanese Patent No. 4198224
PTL 2: Japanese Patent No. 3860135
PTL 3: Japanese Patent No. 1997066357

SUMMARY OF INVENTION

Technical Problem

However, the techniques described in PTL 1 to 3 have not been able to effectively suppress the oxidation of molten materials.

The present invention was made to solve the above problems, and an object of the present invention is to provide a melting furnace capable of suppressing oxidation of a molten material and improving the quality of the molten material.

Solution to Problem

The melting furnace according to the present invention includes a melting portion to which a metal material is supplied; a burner for melting the metal material in the melting portion into a molten material; a heating portion that receives the molten material from the melting portion, wherein the molten material is heated by radiant heat of combustion gas injected from the burner in the melting portion to raise the temperature of the molten material; a temperature regulating portion that receives the molten material from the heating portion and stores the molten material; a separator that separates the heating portion and the temperature regulating portion, wherein the lower portion of the separator is immersed in the molten material to form, below the separator, an inlet that allows introduction of the molten material from the heating portion into the temperature regulating portion; an immersion heater wherein at least part of the immersion heater is immersed in the molten material in the temperature regulating portion to thereby heat the molten material; and a gas introduction path that is formed in the separator to connect the melting portion and the temperature regulating portion, and that introduces combustion gas injected from the burner in the melting portion into a space above the molten material in the temperature regulating portion; wherein the burner is controlled so that the combustion gas has an oxygen concentration of 5% or less.

In the melting furnace according to the present invention, the burner is preferably controlled so that the combustion gas has an oxygen concentration of 3% or less.

In the melting furnace according to the present invention, the gas introduction path is preferably inclined so that an outlet on the side of the temperature regulating portion is disposed in a higher position than an inlet on the side of the melting portion In the melting furnace according to the present invention, it is preferable that combustion gas introduced into the temperature regulating portion through the gas introduction path is adjusted to 10% or more and 20% or less of the gas combustion amount of the burner.

In the melting furnace according to the present invention, it is preferable that the temperature regulating portion is provided with a first exhaust port on its inner wall or ceiling, and the first exhaust port is provided with an adjustment damper for adjusting the exhaust amount.

It is preferable that the melting furnace according to the present invention further includes a preheating portion that includes a material supplying path and a lid, that the temperature regulating portion is further provided with a first open/close damper at the first exhaust port, and that the preheating portion is provided with a second exhaust port on the lid, and the second exhaust port is provided with a second open/close dumper.

Advantageous Effects of Invention

According to the melting furnace of the present invention, oxidation of molten materials can be suppressed, and the quality of the molten material can be improved.

DESCRIPTION OF EMBODIMENTS

The melting furnace according to the present invention includes a melting portion for melting a metal material (particularly a non-ferrous metal material), such as aluminum or an aluminum alloy; a heating portion that is disposed in the vicinity of the melting portion, receives a molten material generated in the melting portion, and heats the molten material; and additionally a temperature regulating portion for receiving the molten material heated in the heating portion for the subsequent casting process, holding the molten material at a predetermined temperature, and storing the molten material.

In the melting furnace according to the present invention, the oxygen concentration in the combustion gas (flame) of the burner for melting the metal material in the melting portion is controlled to 5% or less, and some of the combustion gas is introduced into the temperature regulating portion through the gas introduction path. In the temperature regulating portion, the combustion gas reacts with the molten material to form a thin and dense oxide film. The resulting oxide film protects the molten material, thereby suppressing the oxidation of the molten material. Thus, the amount of oxide generated in the temperature regulating portion is reduced, and the quality of the molten material is improved. The melting furnace according to the present invention also provides protection against the oxide film formed in the temperature regulating portion.

Figure 1:
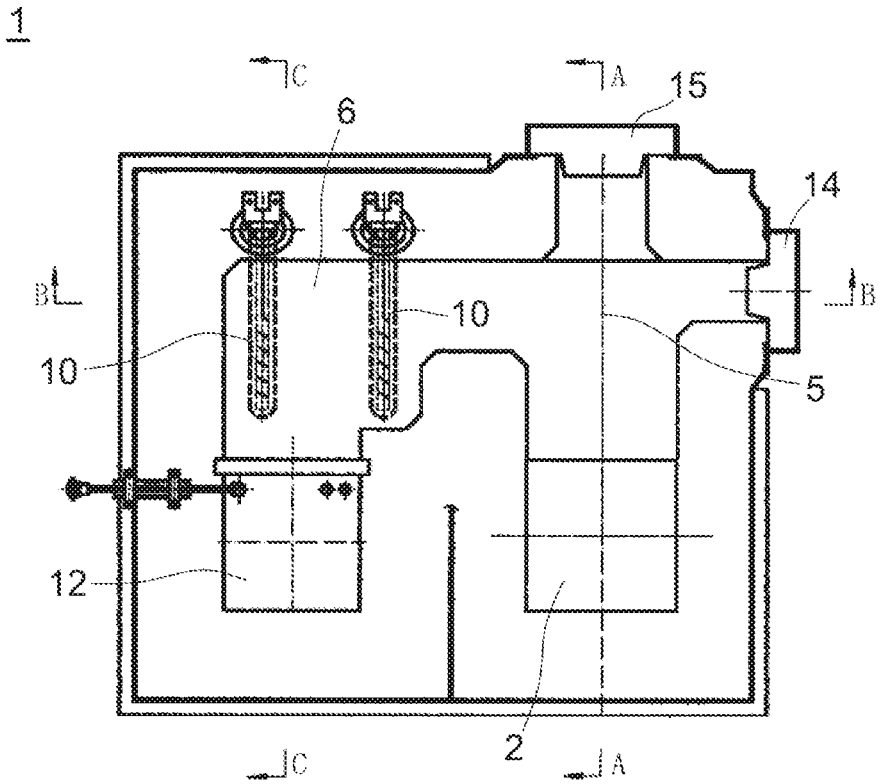
FIG. 1 is a plan view of a melting furnace according to the present embodiment.
Figure 2:
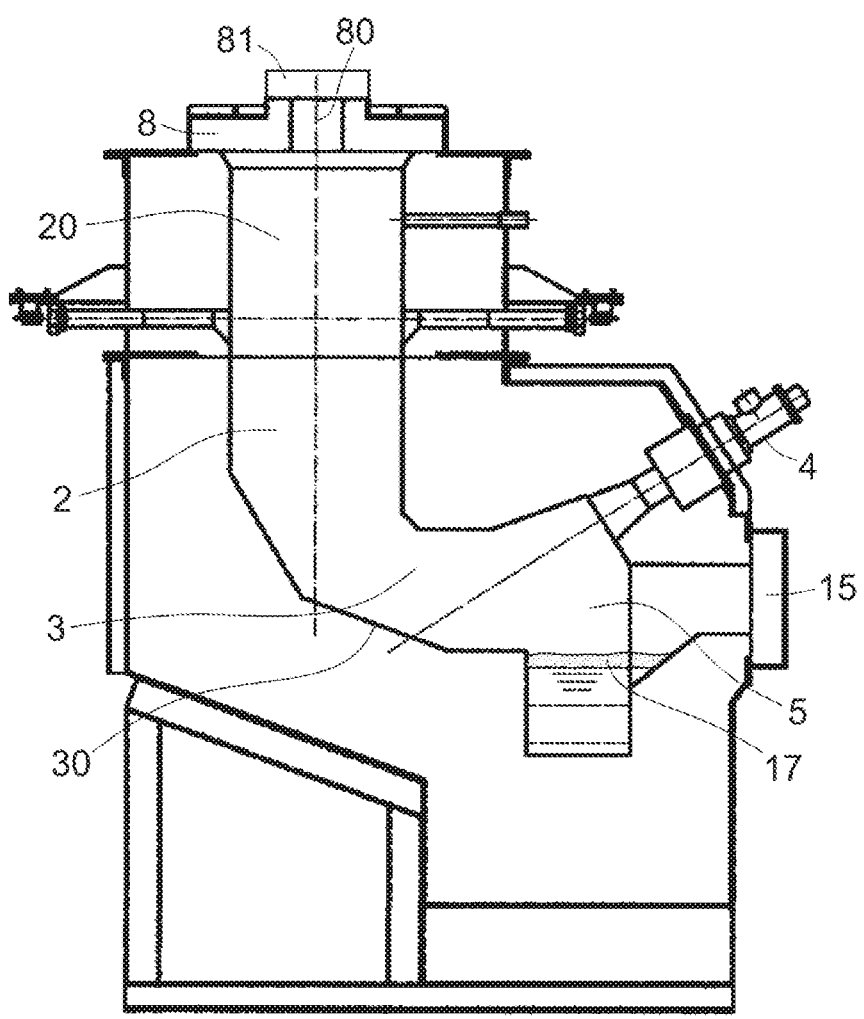
FIG. 2 is a sectional view along the A-A line shown in FIG. 1.
Figure 3:
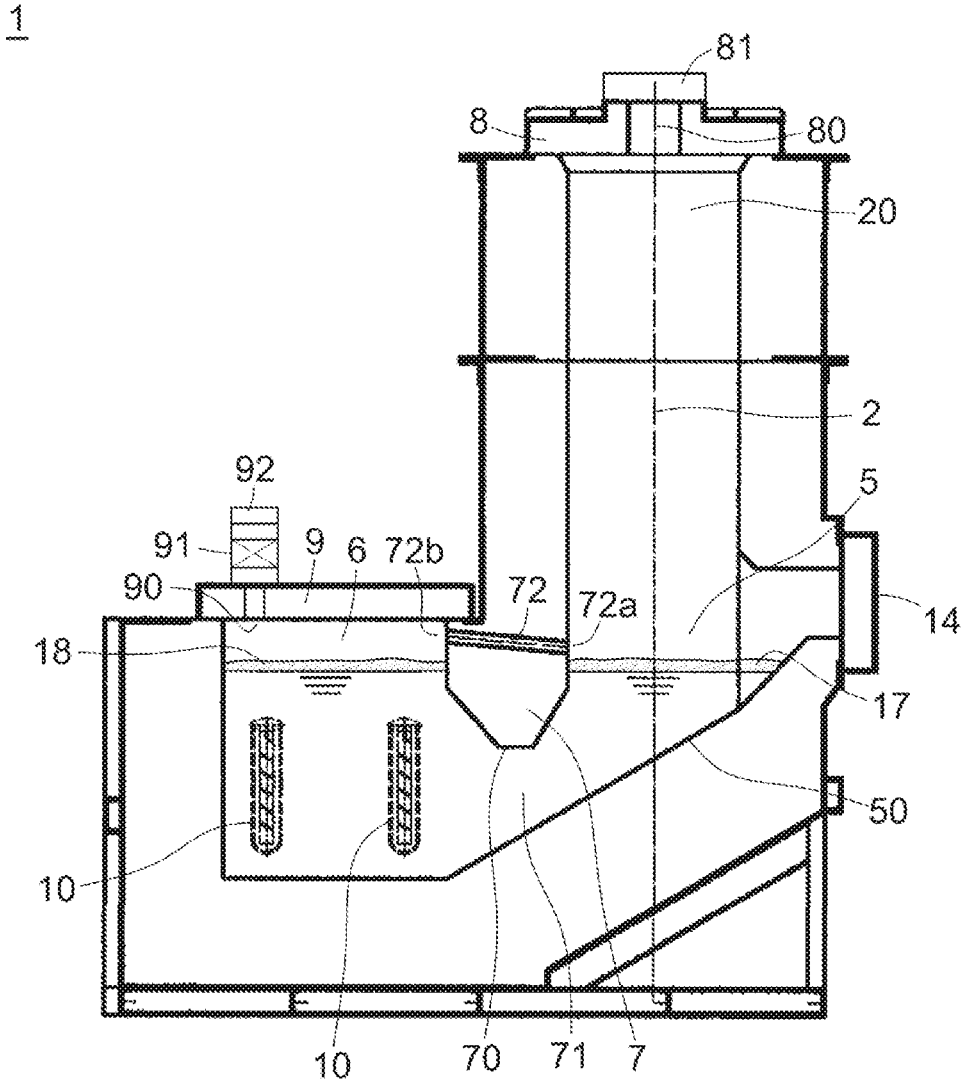
FIG. 3 is a sectional view along the B-B line shown in FIG. 1.
Figure 4:
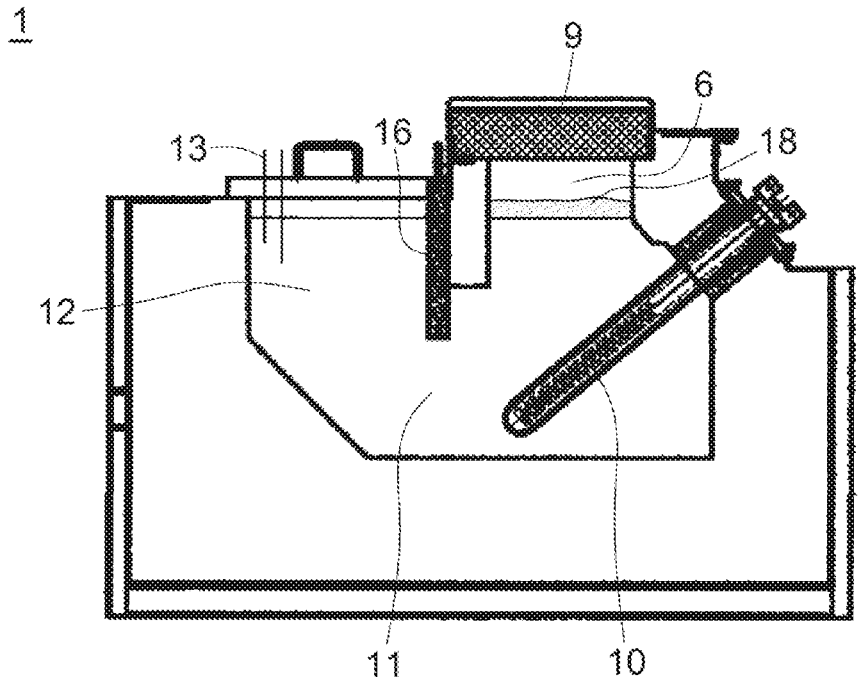
FIG. 4 is a sectional view along the C-C line shown in FIG. 1.
Figure 5:
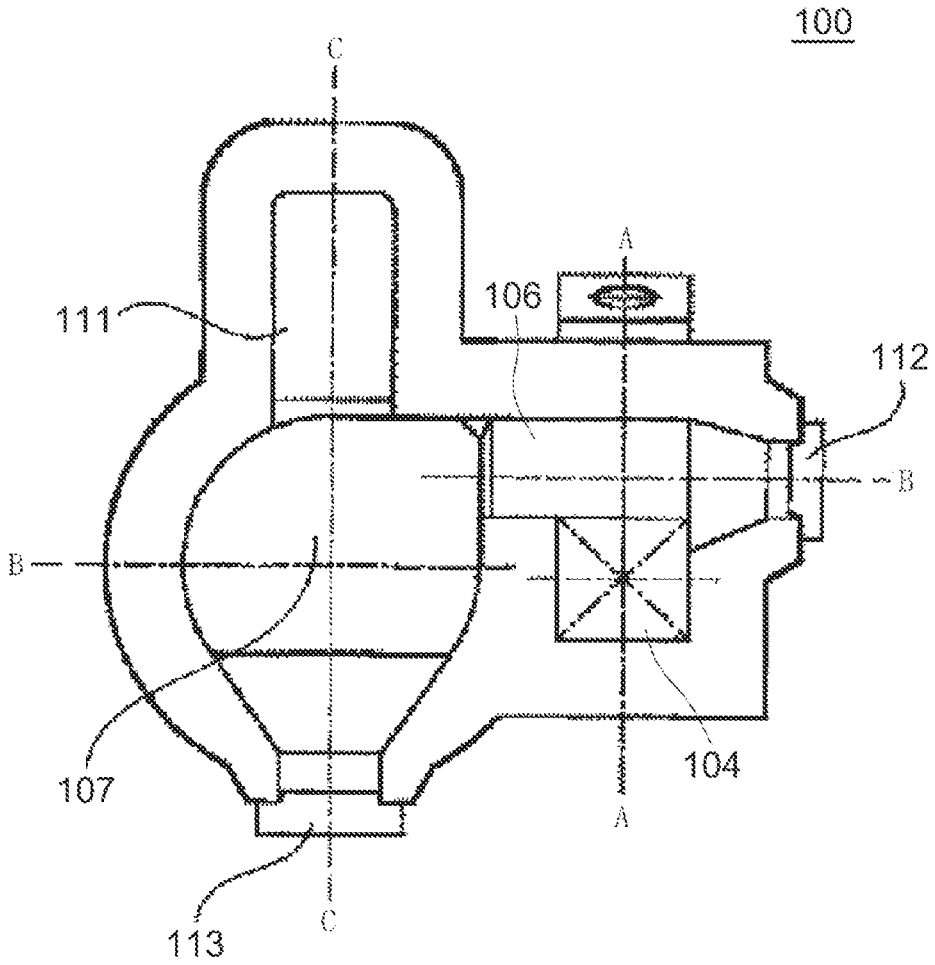
FIG. 5 is a plan view of a conventional melting furnace.
Figure 6:
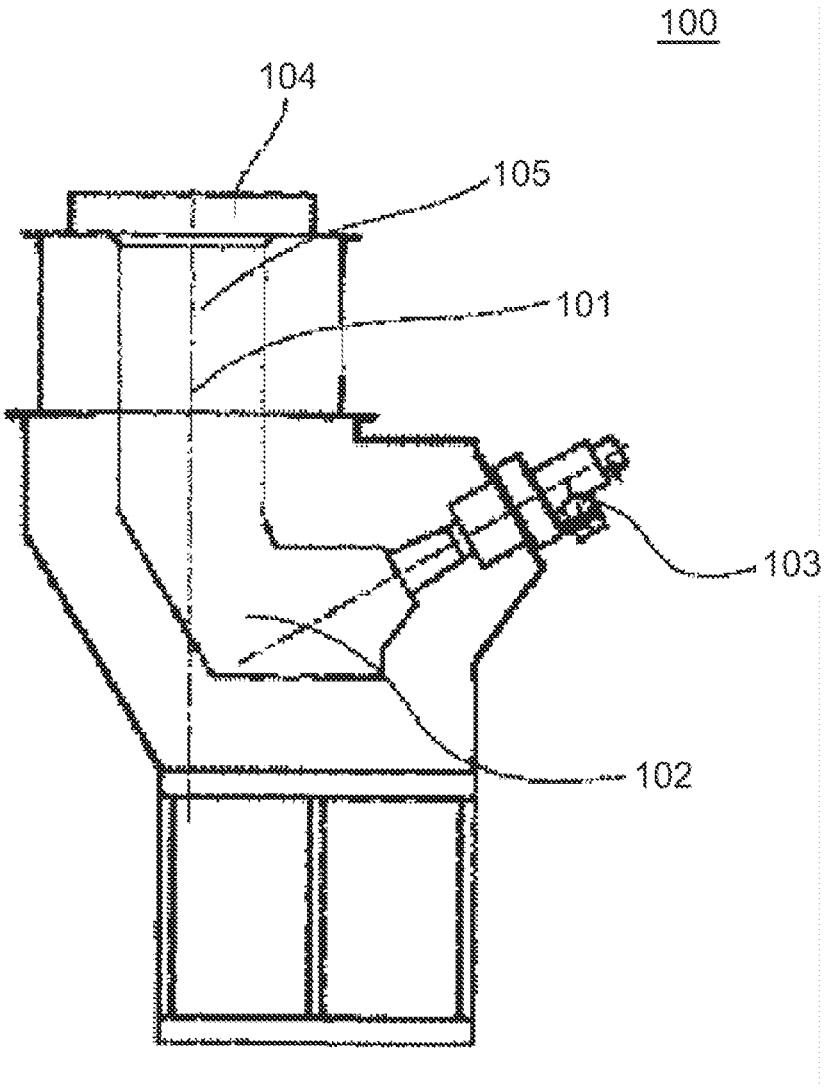
FIG. 6 is a sectional view along the A-A line shown in FIG. 5.
Figure 7:
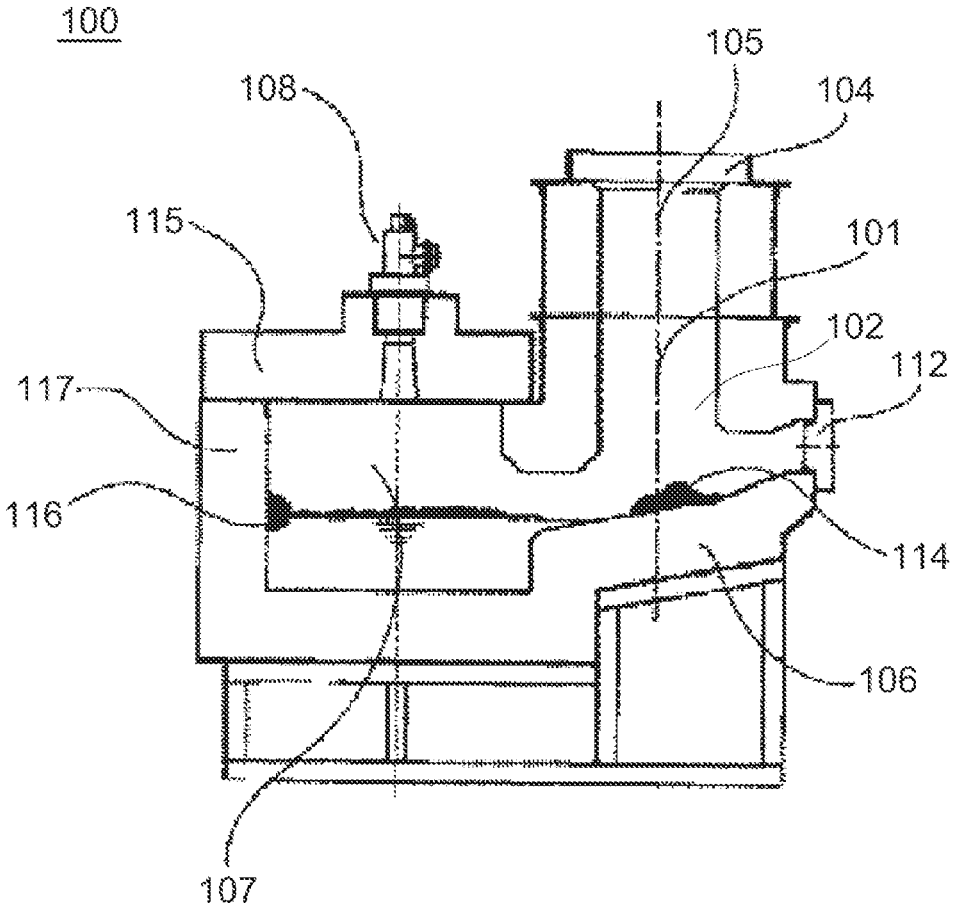
FIG. 7 is a sectional view along the B-B line shown in FIG. 5.
Figure 8:
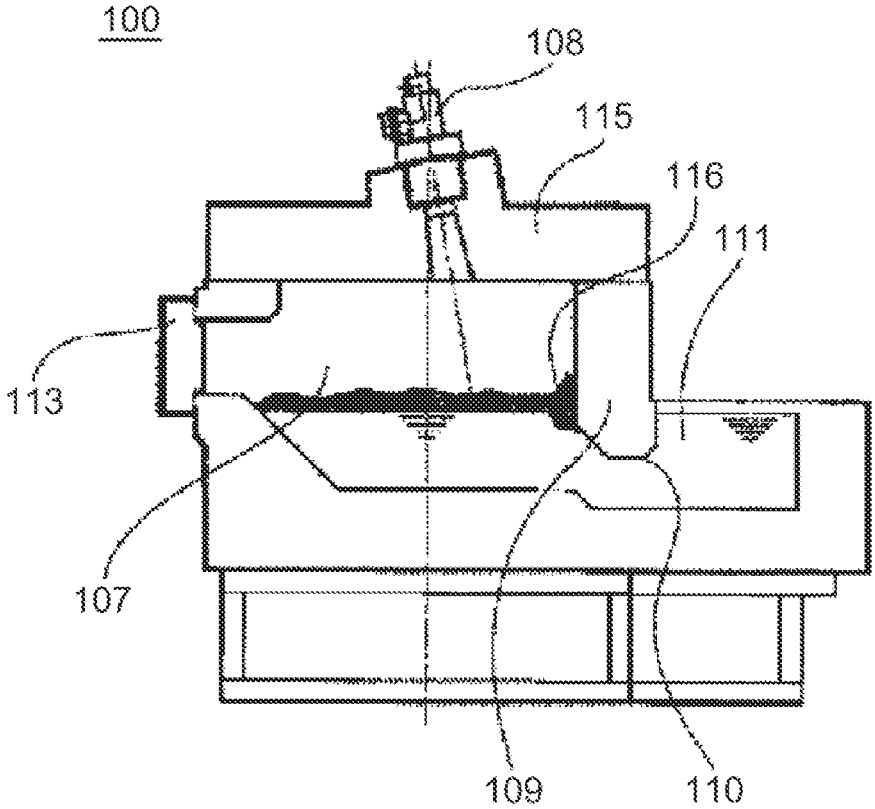
FIG. 8 is a sectional view along the C-C line shown in FIG. 5.

Embodiments of the melting furnace according to the present invention are described below with reference to drawings. FIGS. 1 to 4 show schematic configurations of the melting furnace 1 of the present embodiment. The melting furnace 1 is for melting and holding a metal material such as aluminum or an aluminum alloy, and is mainly configured by a preheating portion 2, a melting portion 3, a heating portion 5, a temperature regulating portion 6, and a pumping portion 12. A burner 4 is provided in the melting portion 3, and an immersion heater 10 is provided in the temperature regulating portion 6.

The preheating portion 2 has a tubular shape having a material supplying path 20 inside, and an openable and closable lid 8 is formed on the top. The preheating portion 2 guides the supplied metal material to the melting portion 3 below the preheating portion 2, and also functions as a flue for the combustion gas emitted from the burner 4. An exhaust port (second exhaust port) 80 for combustion gas is formed in the lid 8, and an open/close damper 81 is provided in the exhaust port 80.

The melting portion 3 receives and melts the metal material supplied from the preheating portion 2. A burner 4 that injects combustion gas (flame) in an oblique downward direction toward the metal material in the melting portion 3 is provided in the furnace wall of the melting furnace 1. The metal material in the melting portion 3 is melted by the heat of the combustion gas (flame) from the burner 4 into a molten material. The molten material generated in the melting portion 3 flows downwardly over the sloping floor 30 of the melting portion 3 that is inclined downwardly toward the heating portion 5, and flows into the heating portion 5.

As the burner 4, a conventionally known combustion burner for performing combustion by appropriately mixing combustion air with fuel gas can be used. An appropriate number of burners 4 can be provided in accordance with the size of the melting portion 3, the melting capacity of the burner 4, and the like. In the burner 4, the oxygen concentration in the combustion gas (flame) is controlled to 5% or less, and preferably 3% or less, to suppress an oxidation reaction occurring in the melting of the metal material by combustion gas (flame).

In the present disclosure, the gas amount is defined by volume, and the volume is the standard volume at 0° C. and 1 atm (the unit is $m^3_N$ (normal cubic meters)). The percentage in the oxygen concentration is the volume % based on the volume. In fact, combustion using a burner is performed with an air amount larger than the theoretical air amount in order to completely burn fuel gas. Since the air amount is set to an excess amount, there is excess oxygen in the combustion gas generated after combustion. In the present disclosure, the oxygen concentration in the combustion gas is controlled to 5% or less by volume, and preferably 3% or less by volume.

The heating portion 5 receives the molten material from the melting portion 3, and raises the temperature of the molten material. In the present embodiment, the burner 4 is disposed in the vicinity of and above the heating portion 5, and the molten material is heated by radiant heat of combustion gas (flame) that is injected from the burner 4 of the melting portion 3 toward the metal material in the melting portion 3 to raise its temperature. However, the method of heating the molten material in the heating portion 5 is not particularly limited.

Doors 14 and 15 that can be opened and closed are provided on the furnace wall facing the heating portion 5 of the melting furnace 1. The doors 14 and 15 can be opened for inspecting and cleaning the melting portion 3 and the heating portion 5. The molten material heated in the heating portion 5 flows downwardly on a connecting path 50 that forms the bottom of the heating portion 5 and that is inclined downwardly toward the temperature regulating portion 6, and flows into the temperature regulating portion 6.

The heating portion 5 and the temperature regulating portion 6 are separated by a separator 7. The lower portion 70 of the separator 7 is immersed in the molten material. An inlet 71 that connects the heating portion 5 and the temperature regulating portion 6 to allow the introduction of the molten material from the heating portion 5 to the temperature regulating portion 6 is formed below the separator 7, i.e., between the lower portion 70 of the separator 7 and the connecting path 50.

Since the lower portion 70 of the separator 7 is immersed in the molten material, it is possible to inhibit the introduction of the oxide 17 that floats on the liquid surface of the molten material introduced from the heating portion 5 into the temperature regulating portion 6, into the temperature regulating portion 6 together with the molten material, and the mixing of the oxide 17 with the molten material in the temperature regulating portion 6. Thus, the molten material in the temperature regulating portion 6 is protected from the oxide 17.

In the separator 7, a gas introduction path 72 that connects the melting portion 3 and the temperature regulating portion 6, and introduces combustion gas that is injected from the burner 4 of the melting portion 3 into the melting portion 3 into a space above the molten material in the temperature regulating portion 6, is formed. In the present embodiment, the gas introduction path 72 is inclined so that the outlet **72*b* on the side of the temperature regulating portion 6 is disposed at a higher position than the inlet 72*a* on the side of the melting portion 3. This configuration prevents combustion gas introduced into the temperature regulating portion 6 from covering an oxide film 18 (described later) formed on the liquid surface of the molten material in the temperature regulating portion 6. A plurality of gas introduction paths 72 may be formed on the separator 7**, and they are not necessarily inclined.

The temperature regulating portion 6 holds the molten material at a predetermined temperature before the molten material is pumped out from a pumping portion 12. An exhaust port (first exhaust port) 90 for combustion gas is formed in an openable/closable lid 9 that constitutes the ceiling of the temperature regulating portion 6. The combustion gas introduced from the melting portion 3 into the temperature regulating portion 6 is discharged outside the melting furnace 1 from the exhaust port 90. The exhaust port 90 is provided with an adjustment damper 91 for adjusting the amount of combustion gas to be discharged and an open/close damper 92. By adjusting the amount of combustion gas discharged from the exhaust port 90 using the adjustment damper 91, the amount of combustion gas introduced from the melting portion 3 into the temperature regulating portion 6 through the gas introduction path 72 can be adjusted. The combustion gas to be introduced into the temperature regulating portion 6 through the gas introduction path 72 is preferably 10, or more and 20% or less, and more preferably about 10% of the gas combustion amount of the burner 4. The percentages above are the volume % based on the volume.

One or more immersion heaters 10 are provided in the temperature regulating portion 6. The immersion heater 10, at least part of which is immersed in the molten material in the temperature regulating portion 6, heats the molten material. As the immersion heater 10, a conventionally known immersion heater can be used. For example, an immersion tube is heated by an internal heater or a burner of the immersion tube to thereby heat a molten material in contact with the immersion tube. In the present embodiment, the immersion heater 10 is mounted to the furnace wall of the melting furnace 1 so as to be inserted obliquely relative to the molten material in the temperature regulating portion 6. This significantly reduces the size of the internal heater of the immersion tube. The immersion heater 10 is not necessarily inserted obliquely relative to the molten material in the temperature regulating portion 6.

The molten material in the temperature regulating portion 6 is heated from the inside by the immersion heater 10, and is also heated from the liquid surface by the combustion gas introduced into the temperature regulating portion 6 through the gas introduction path 72 to keep its temperature high. During heating, a thin and dense oxide film 18 is formed on the liquid surface of the molten material by combustion gas with a low oxygen concentration that is introduced into the temperature regulating portion 6. Since such an oxide film 18 floats on the liquid surface of the molten material, and is dense and has a protective function, it serves as a barrier for preventing gas absorption or oxidation of the molten material. Accordingly, the oxide film 18 suppresses the oxidation of the molten material, and improves the quality of the molten material.

The pumping portion 12 is provided in a manner such that it is connected to the temperature regulating portion 6, and is separated from the temperature regulating portion 6 by a separating wall 16. The lower portion of the separating wall 16 is immersed in the molten material, and a connecting port 11 that connects the temperature regulating portion 6 and the pumping portion 12 to allow the movement of the molten material from the temperature regulating portion 6 to the pumping portion 12 is formed below the separating wall 16. The molten material that has moved to the pumping portion 12 is suitably pumped out and used in a casting process or the like.

A detection means 13 for measuring the position (height) of the liquid surface of the molten material stored in the pumping portion 12 is provided in the pumping portion 12. As the detection means 13, various known measuring instruments and sensors can be used as long as they can measure the position (height) of the liquid surface of the molten material. The position (height) of the liquid surface of the molten material stored in the pumping portion 12 is at the same level as the position (height) of the liquid surface of the molten material stored in the temperature regulating portion 6 and the heating portion 5. Therefore, by detecting the position (height) of the liquid surface of the molten material stored in the pumping portion 12, the position (height) of the liquid surface of the molten material can be maintained at a position higher than the lower portion 70 of the separator 7 without overflowing the molten material from the pumping portion 12. The detection means 13 can be provided at any portion in the melting furnace 1 other than the pumping portion 12.

According to the melting furnace having the above structure of the present embodiment, the oxidation of the molten material is suppressed because the oxygen concentration in the combustion gas introduced into the temperature regulating portion 6 is as low as 5% or less. Further, since the combustion gas forms the thin and dense oxide film 18 on the liquid surface of the molten material in the temperature regulating portion 6, and the molten material is protected by the oxide film 18, the oxidation of the molten material is suppressed. Furthermore, since the heating portion 5 is provided between the melting portion 3 and the temperature regulating portion 6, and the molten material melted in the melting portion 3 is heated in the heating portion 5, and is supplied into the temperature regulating portion while raising the temperature of the molten material, the temperature for heating the molten material in the temperature regulating portion 6 can be reduced, which allows the thin and dense oxide film 18 to be maintained for a long period of time without deterioration. Thus, in the melting furnace 1 according to the present embodiment, the oxidation of the molten material in the temperature regulating portion 6 can be reduced to suppress an increase in the amount of oxide, which makes it possible to improve the quality of the molten material in the temperature regulating portion 6. Moreover, the removal operation of the oxide in the temperature regulating portion 6, which is required in the conventional technique, can be greatly reduced or eliminated.

Further, when the burner 4 is stopped, by closing the open/close damper 92 of the temperature regulating portion 6 and the open/close damper 81 of the preheating portion 2 to firmly close the preheating portion 2, the melting portion 3, and the temperature regulating portion 6, and by preventing combustion gas in the preheating portion 2, the melting portion 3, and temperature regulating portion 6 from being replaced with outside air, the oxidation of the molten material in the melting portion 3, the heating portion 5, and the temperature regulating portion 6 can be suppressed, and the heat loss can be also suppressed.

One embodiment of the present invention is explained above; however, the present invention is not limited to the above embodiment, and various modifications are possible as long as the gist of the present invention is not impaired.

The invention claimed is:

1. A melting furnace including:

a melting portion to which a metal material is supplied, the melting portion having a sloping floor inclined downwardly;

a burner for melting the metal material in the melting portion into a molten material;

a heating portion that receives the molten material from the melting portion through the sloping floor of the melting portion, which is inclined downwardly toward the heating portion, wherein the molten material is heated by radiant heat of combustion gas injected from the burner in the melting portion to raise the temperature of the molten material;

a temperature regulating portion that receives the molten material from the heating portion and stores the molten material;

a connecting path from the heating portion toward the temperature regulating portion, such that the molten material in the heating portion flows on the connecting path into the temperature regulating portion;

a separator that separates the heating portion and the temperature regulating portion, wherein the lower portion of the separator is immersed in the molten material; and an inlet that connects the heating portion and the temperature regulating portion, formed between the lower portion of the separator and the connecting path, to allow introduction of the molten material from the heating portion into the temperature regulating portion;

an immersion heater wherein at least part of the immersion heater is immersed in the molten material in the temperature regulating portion to thereby heat the molten material; and a gas introduction path that is formed in the separator to connect the melting portion and the temperature regulating portion, and that introduces combustion gas injected from the burner in the melting portion into a space above the molten material in the temperature regulating portion;

wherein the burner is configured so that the combustion gas has an oxygen concentration of 5% or less.

2. The melting furnace according to claim 1, wherein the gas introduction path is inclined so that an outlet on the side of the temperature regulating portion is disposed in a higher position than an inlet on the side of the melting portion.

3. The melting furnace according to claim 1, further including:

an inner wall or ceiling of the temperature regulating portion, a first exhaust port on the inner wall or ceiling, and an adjustment damper in the first exhaust port, for adjusting an exhaust amount;

wherein:

the adjustment damper is configured such that the combustion gas introduced into the temperature regulating portion via the gas introduction path is 10% or more and 20% or less of the gas combustion amount of the burner.

4. The melting furnace according to claim 3, wherein the melting furnace further includes a preheating portion that includes a material supplying path and a lid, and that is positioned above the melting portion, the temperature regulating portion is further provided with a first open/close damper at the first exhaust port, and the preheating portion is provided with a second exhaust port on the lid, and the second exhaust port is provided with a second open/close damper.

5. The melting furnace according to claim 2, further including:

an inner wall or ceiling of the temperature regulating portion, a first exhaust port on the inner wall or ceiling, and an adjustment damper in the first exhaust port, for adjusting an exhaust amount; wherein:

the adjustment damper is configured such that the combustion gas introduced into the temperature regulating portion via the gas introduction path is 10% or more and 20% or less of the gas combustion amount of the burner.

* * * * *